US007757417B1

(12) United States Patent
Koski et al.

(10) Patent No.: US 7,757,417 B1
(45) Date of Patent: Jul. 20, 2010

(54) VEHICLE MOUNTABLE DISPLAY DEVICE

(75) Inventors: Michael A. Koski, Phoenix, AZ (US); Nora Op, Phoenix, AZ (US); Paul Gibson, Phoenix, AZ (US)

(73) Assignee: Nemesis, Inc., Phoenix, AZ (US)

( * ) Notice: Subject to any disclaimer, the term of this patent is extended or adjusted under 35 U.S.C. 154(b) by 0 days.

(21) Appl. No.: 12/363,316

(22) Filed: Jan. 30, 2009

Related U.S. Application Data

(63) Continuation-in-part of application No. 29/323,115, filed on Aug. 18, 2008, now Pat. No. Des. 609,277.

(60) Provisional application No. 61/024,818, filed on Jan. 30, 2008.

(51) Int. Cl.
*G09F 21/04* (2006.01)

(52) U.S. Cl. ..... 40/424; 40/591; 40/593

(58) Field of Classification Search ..... 40/591–593, 40/613, 425, 424; 446/102, 149
See application file for complete search history.

(56) References Cited

U.S. PATENT DOCUMENTS 1,168,751 A * 1/1916 Schuhmann ..... 40/424
2,389,606 A * 11/1945 Borregard ..... 40/423
D527,305 S * 8/2006 Weiser ..... D11/162
2004/0221495 A1* 11/2004 Hogestad ..... 40/421

FOREIGN PATENT DOCUMENTS

JP 2000259109 A * 9/2000

* cited by examiner

*Primary Examiner*—Cassandra Davis
(74) *Attorney, Agent, or Firm*—Fennemore Craig, P.C.

(57) ABSTRACT

The present invention is directed to a vehicle mountable display device. The device includes a first adversarial profile and a second adversarial profile. Between the first adversarial profile and the second adversarial profile is a first extension, which is part of or attached to the first adversarial profile. The first extension is made of a flexible material and/or pivotably or flexibly connected to the first adversarial profile such that while driving the extension can move back and forth in the appearance of slapping or hitting the second adversarial profile. The first adversarial profile is preferably a user's preferred choice and the second adversarial profile is preferably a rival or challenger, thereby effectively communicating a user's preferred choice, while also communicating the adversarial nature between the two with minimal or no words. The device further includes a mounting element for securely attaching to the vehicle.

12 Claims, 7 Drawing Sheets

VEHICLE MOUNTABLE DISPLAY DEVICE

PRIORITY

This application claims priority under 35 USC 119(e) to provisional application No. 61/024,818 and claims priority under 35 USC 120 to design patent application No. 29/323,115. Both of the above applications are hereby incorporated by reference herein.

FIELD OF THE INVENTION

The present invention is directed to a vehicle mountable display device for communicating to the general public a user's preference in an up coming event or rivalry.

BACKGROUND OF THE INVENTION

Automobiles have served as a host for a wide variety of signs, banners and flags for decades. These objects have served a number of purposes, including advertising, and/or demonstrating school or team spirit. Many devices have been developed to facilitate the attachments of these products to automobiles or other vehicles and various patents have been issued in the past on these devices.

Common devices include flags, slogans, and messages attached to a vehicle hood, trunk, or window. These devices are useful in displaying team names or slogans, but are largely ineffective at displaying the adversarial nature between two players, teams, politicians, etc. Many of these devices do not even provide a means of communicating who the challenger is for a particular game or event. The present invention provides a unique means of effectively communicating this information with minimal or no words.

SUMMARY OF THE INVENTION

The present invention is directed to a vehicle mountable display device. The intent of this invention is to provide a means of effectively communicating a user's preferred choice and their rivals, while also communicating the adversarial nature between the two with minimal or no words. In one embodiment the device comprises: a first adversarial profile and a second adversarial profile. Between the first adversarial profile and the second adversarial profile is a protrusion or first extension, which is part of or attached to the first adversarial profile, e.g., pivotally, slidably, snapably, or adhesively. The first extension is preferably made of a flexible material, such that, while driving, the first extension can move back and forth in the appearance of slapping or hitting the second adversarial profile. In another embodiment, however, the first extension is rigid or semi-rigid and is pivotally or flexibly connected to the first adversarial profile so that the first extension can move back and forth in the appearance of slapping or hitting the second adversarial profile. The first adversarial profile is preferably the user's preferred choice, e.g., team, player, politician, etc. The second adversarial profile is preferably the rival or challenger. The device further comprises a mounting element for securely attaching to the vehicle. Once the vehicle starts in motion, the surrounding pressure forces the parallel first extension that is extending from the first adversarial profile to the second adversarial profile, which is comprised of flexible material, to flap back and forth in the hitting or slapping motion as described above.

In one preferred embodiment, the first adversarial profile and second adversarial profile are made of one piece of material, preferably weather resistant plastic or plastic combination, e.g., plastic and cloth or plastic and metal. Furthermore, typically the first adversarial profile is taller and/or larger than the second adversarial profile to show superiority to the second adversarial profile. In one non-limiting embodiment, the first and second adversarial profiles are in the shape of a human profile and are made of suitable material and of suitable size to attach a picture or drawing, preferably in the form of a sticker. The stickers depict the user's preferred choice, e.g., team or player, and the rival.

In an optional embodiment, the device further comprises a second extension attached to an upper portion of the first adversarial profile. Preferably, the second extension is in the shape of a blurb bubble of sufficient size that various words or phrases may be displayed or alternatively, in the shape of a tongue displaying the user's dislike for the opposing team or politician.

In a preferred embodiment, the first extension extends sufficiently to hit the second adversarial profile while the vehicle is in motion in a slapping or hitting manner. In another embodiment, the first extension extends towards the second adversarial profile, without hitting the second adversarial profile, preferably within 1 or 2 inches. Preferably, the first extension is in the form of a hand, arm, leg, hockey stick, baseball bat, or other sporting equipment.

In one non-limiting embodiment, the first extension is fixedly attached to the first adversarial profile and is made of a weather resistant, flexible material, such as plastic, cloth, or a plastic combination.

BRIEF DESCRIPTION OF THE DRAWINGS

Referring now to the attached drawings which form a part of this original disclosure.

Figure 1:
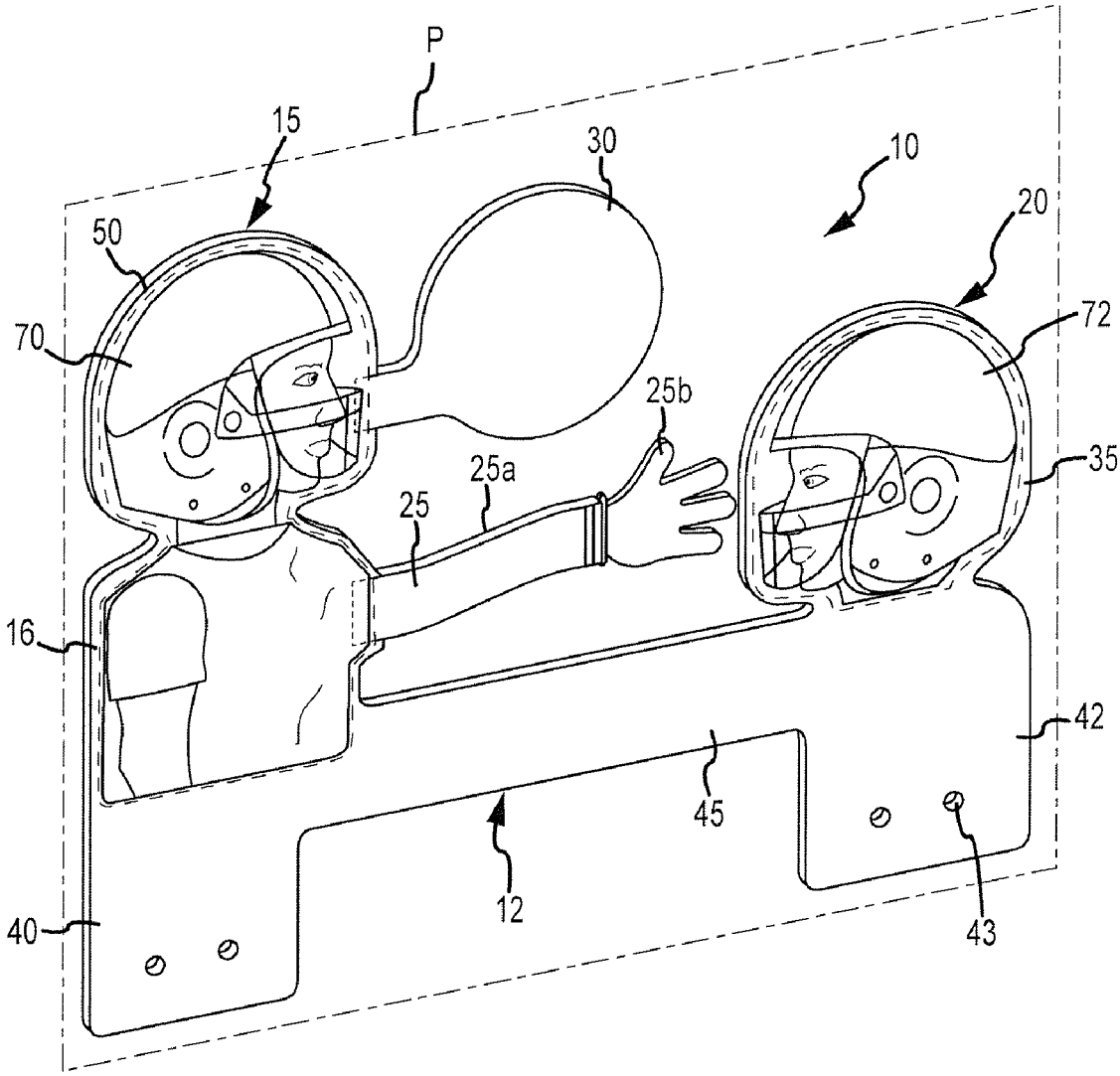
FIG. 1 is a perspective view of the vehicle mountable display device having first and second extensions according to an embodiment having a flexible extension.
Figure 6A:
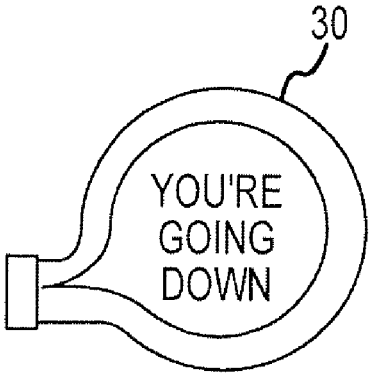
Figure 6B:
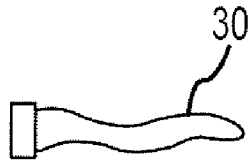
Figure 6C:
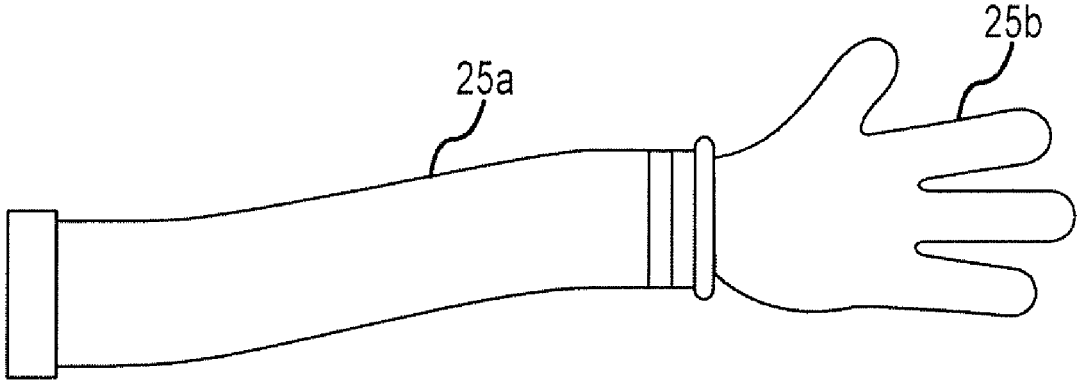
Figure 6D:
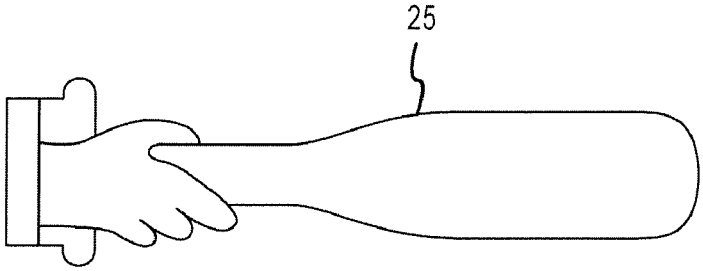
Figure 6E:
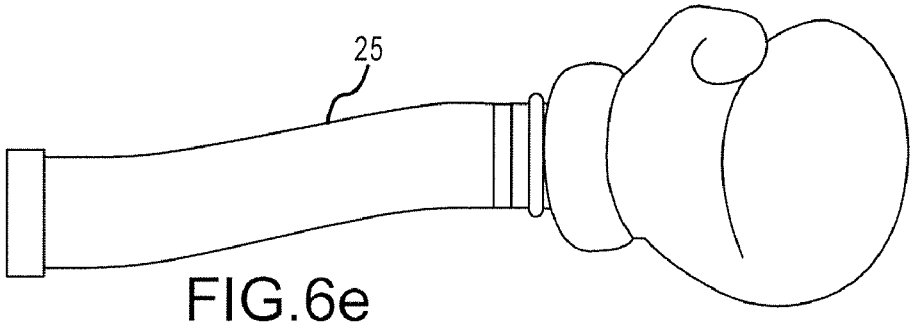
Figure 6F:
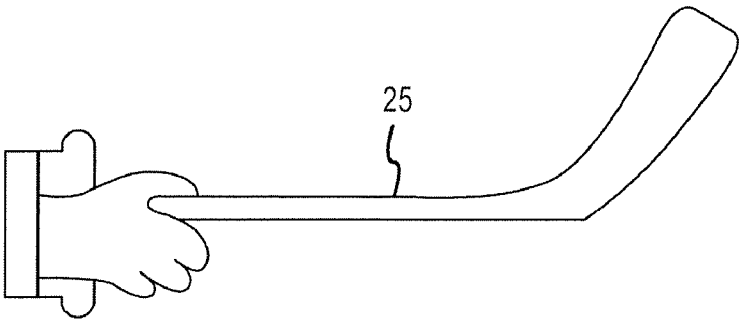

FIG. **6*a* is a side view of the second extension in the form of a bubble with text as shown in FIG. 1**;

FIG. **6*b*** is a side view of an alternative embodiment of the second extension in the form a tongue;

FIG. **6*c* is a side view of the first extension in the form of an arm and hand as shown in FIG. 1**;

FIG. **6*d*** is a side view of an alternative embodiment of the first extension in the form of a hand holding a baseball bat;

FIG. **6*e* is a side view of an alternative embodiment of the first extension in the form of an arm with a boxing glove; and FIG. 6*f*** is a side view of an alternative embodiment of the first extension in the form of a hand holding a hockey stick.

DETAILED DESCRIPTION OF THE PREFERRED EMBODIMENTS

The invention will now be described in reference to the preferred embodiments of the invention for purposes of illustration only. It will be understood by one skilled in the art that numerous modifications or alterations may be made in and to the illustrated embodiments without departing from the spirit and scope of the invention.

Referring to FIG. 1, the vehicle mountable display device 10 comprises a body 12 having a first adversarial profile 15 and a second adversarial profile 20. The first adversarial profile 15 and the second adversarial profile 20 are connected by a midsection 45. In one preferred embodiment, the body 12 of the vehicle mountable display device 10 is made of a composite material, preferably rigid, and forming the shape of a "U" with the first and second adversarial profiles 15, 20. Preferably, the first adversarial profile 15 and second adversarial profile 20 are disposed on respective ends of the body 12 and jut vertically upwards. In the embodiment where the first and second adversarial profiles 15, 20 are both in a shape resembling that of a human profile, the human profiles are situated so that they are facing each other. Between the first adversarial profile 15 and the second adversarial profile 20 is a protrusion or first extension 25, which is attached to the first adversarial profile 15 near the midsection 45. The first extension 25 extends horizontally towards the second adversarial profile 20. A second extension 30 is also attached to the first adversarial profile 15 at an upper portion 50 of the first adversarial profile 15—a further distance from the midsection 45.

In one preferred embodiment, the body 12, including the first adversarial profile 15, the second adversarial profile 20 and the midsection 45, is made of one piece of material, preferably weather resistant plastic. That is, the first and second adversarial profiles 15, 20 and the midsection 45 form a one-piece integral unitary member. Alternatively, the first and second adversarial profiles 15, 20, the midsection 45, first extension 25 and the second extension 30 form a one-piece integral unitary member. The body 12 is about 0.25 in. thick and about 16.25 in. long, for example.

Figure 5:
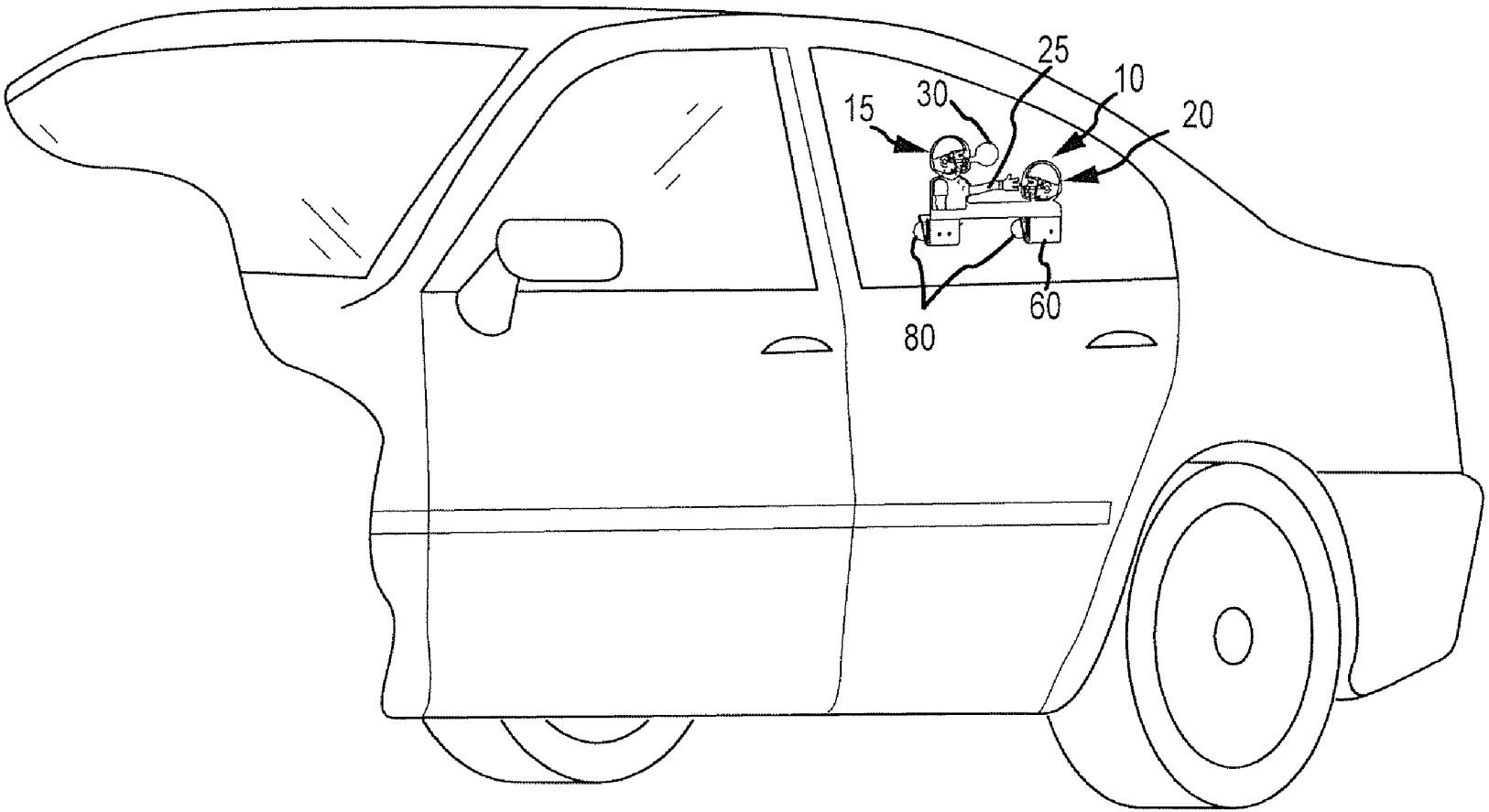
FIG. 5 shows the vehicle mountable display device mounted to a vehicle window using another embodiment of the mounting element having suction cups.

The vehicle mountable display device 10 further comprises a mounting element 60 for securely attaching the device 10 to a vehicle. Preferably, the mounting element 60 is for a window, hood, license plate or trunk. That is, the mounting element 60 is configured to mount to the vehicle, thereby mounting the device 10 to the vehicle. FIGS. 5 and 6 show the mounting element 60 and the vehicle mountable display device 10 attached to the vehicle in various ways via the mounting element 60. It will be apparent to one of ordinary skill in the art from this disclosure that the vehicle mountable display device 10 can be mounted to the vehicle in various ways using various configurations of the mounting element 60.

The first adversarial profile 15 preferably displays a user's preferred choice, opinion, etc. The first adversarial profile 15 can display, for example, an image of a team, player, athlete, politician, team mascot, team logo, etc. The second adversarial profile 20 is disposed on the body 12 so that it is opposed to the first adversarial profile 15. Preferably, the second adversarial profile 20 displays the rival, adversary or challenger. Likewise, the second adversarial profile 20 can display, for example, an image of a team, player, athlete, politician, team mascot, team logo, etc. The first adversarial profile 15 is sized and/or positioned in relation to the second adversarial profile 20 to show superiority or dominance. For example, the first adversarial profile 15 is about 12-14 in. tall and the second adversarial profile 20 side is about 8 in. tall. The adversarial relationship and the user's preferred choice or opinion are made known by the size and/or position of the first adversarial profile 15 relative to the second adversarial profile 20. Thus, the first and second adversarial profiles 15, 20 are defined as profiles that each display an adversary, who contends with, opposes or resists the opposite adversary. Together, the first and second adversarial profiles 15, 20 convey an adversarial relationship or rivalry. Preferably, the first adversarial profile 15 is taller than the second adversarial profile to show superiority to the second adversarial profile 20. With the first extension 25 situated between the first and second adversarial profiles 15, 20, a slapping motion caused as the wind from the vehicle's movement blows past the first extension 25 nonverbal communicating the user's preference to the public; communicating antagonism or superiority of their preferred team or person over the rival.

In a non-limiting embodiment, the first adversarial profile 15 and the second adversarial profile 20 are each in the shape of a human profile and are made of suitable material (plastic, cloth, metal, or a combination thereof) and of suitable size to attach a picture or sticker 70, 72 of the user's choice and the rival. FIG. 1 illustrates one embodiment of a user's choice sticker 70 and rival sticker 72. The user's choice sticker 70 displays, for example, images of a team, player, athlete, politician, team mascot, team logo, etc. The rival sticker 72 preferably displays the rival, adversary or challenger. Referring to FIG. 1, the broken lines on the first and second adversarial profiles 15, 20 trace the outline of where the respective stickers 70, 72 may be placed.

The crux of the nonverbal communication of the vehicle mountable display device 10 is the hitting, slapping, poking, or jabbing motion that is caused by the first extension 25 that extends towards the second adversarial profile 20. The first extension 25, connected to the first adversarial profile 15, is made of a flexible material such that, while driving, the first extension 25 can move side to side in the appearance of slapping or hitting the second adversarial profile 20, preferably in the location of an upper portion or head 35 of the second adversarial profile 20.

In the embodiment shown in FIG. 1, the first extension 25 is flexibly attached to the first adversarial profile 15. Specifically, the user's choice sticker 70 is placed over the connection point between the first extension 25 and the first adversarial profile 15. Preferably, the first extension 25 is made of a weather resistant, flexible material, such as, plastic, a plastic-vinyl combination, or a thin piece of wax paper and/or cloth material. If plastic is used to make any part of the vehicle mountable display device 10, it is preferably UV resistant. More preferably, an arm portion 25*a* of the first extension 25 is made of plastic and a hand portion 25*b* of the first extension 25 is made of cloth. The first extension 25 may be about 5 in. to 8 in., e.g., 6.56 in. in length, about 1 in. to 4 in., e.g. 1.16 in. to about 2.63 in. in width, and about 0.005 to 0.5 in., e.g., 0.015 in. thick, for example. As explained above, the appearance of slapping the second adversarial profile 20 is achieved by the first extension 25 oscillating as the wind from the vehicle's movement blows across the first extension 25. In the embodiment illustrated in FIG. 1, the first extension 25 is flexibly configured to oscillate to provide an appearance of slapping or hitting the second adversarial profile 20. In this embodiment, the first adversarial profile 15 defines a plane P that extends substantially towards the second adversarial profile 20. The first extension 25, flexibly attached to the first adversarial profile 15, oscillates from one side of the plane P to the other side of the plane P as the wind from the vehicle's movement blows across both sides of the first extension 25, thereby providing the appearance of slapping or hitting the second adversarial profile 20. In one embodiment, sufficient space between the first and second adversarial profiles 15, 20 allows the first extension 25 to slap or hit the second adversarial profile 20 as the vehicle moves, thereby contributing to the conveyance of the intended adversarial message. In another embodiment, sufficient space is provided between the first and second adversarial profiles 15, 20 such that the first extension 25 does not actually hit the second adversarial profile 20, but nonetheless oscillates from side to side such that the intended adversarial message is conveyed. Thus, the first extension 25 may or may not overlap/strike the second adversarial profile 20 based upon length, speed of motion, and desired message.

The vehicle mountable display device 10 may optionally further comprise a rigid second extension 30 attached to the upper portion 50 of the first adversarial profile 15. Preferably, the second extension 30 is in the shape of a bubble of sufficient size that various words or phrases may be displayed, as shown in FIG. 6*a*. Alternatively, the second extension 30 can be in the shape of a tongue, illustrated in FIG. 6*b*, displaying the user's dislike for the opposing team, politician, etc displayed by the second adversarial profile 20.

Preferably, the first extension 25 is in the form of a hand, arm, leg, hockey stick, baseball bat or other sporting equipment. FIGS. 6*a*-6*e* illustrate examples of various shapes and forms of the first and second extensions 25, 30. Modifications to the extension 25 reflect the nature of the two opposing forces. For example, for baseball, the extension 25 can be a bat, as shown in FIG. 6*d*; for tennis, the extension 25 can be a tennis racket; for boxing—boxing gloves covering the hand of an out stretched hand, as shown in FIG. 6*e*, etc. FIG. 6*c* illustrates an arm and hand as used in the embodiment of FIG. 1.

Figure 2:
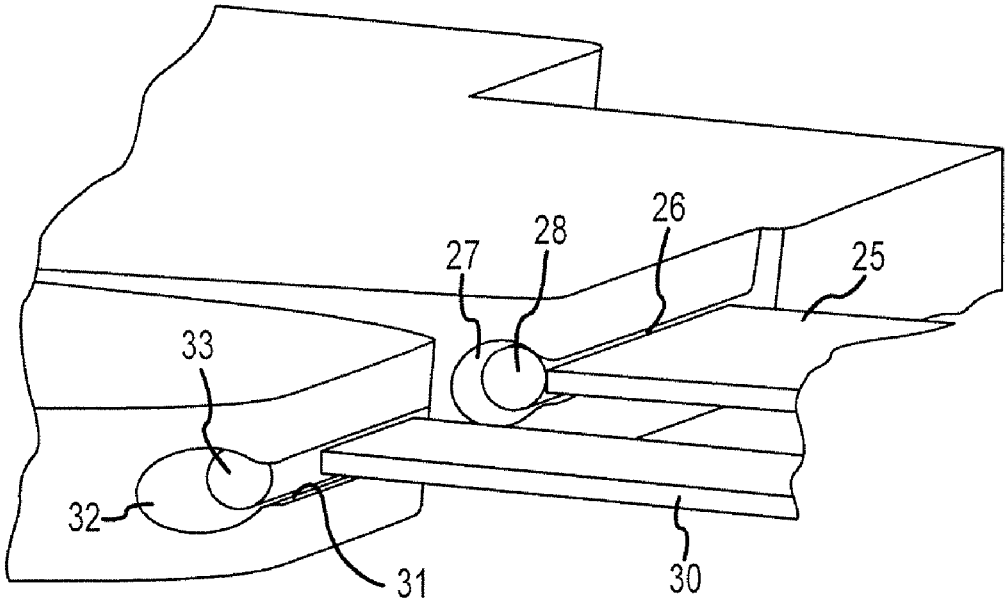
FIG. 2 is a magnified perspective view of the first and second extensions connected to the first adversarial profile according to an embodiment having removable and pivotable first and second extensions.

In the embodiment illustrated in FIG. 2, the first and second extensions 25, 30 are removably and pivotally connected to the first adversarial profile 15. Referring to FIG. 2, cylindrical bores 27, 32 are provided in the first adversarial profile 15 for attaching the first and second extensions 25, 30. The cylindrical pegs 28, 33 are attached to an end portion of the first and second extensions 25, 30, respectively. The pegs 28, 33 have a diameter slightly less than a diameter of the cylindrical bores 27, 32 such that the pegs 28, 33 slide into the respective cylindrical bore 27, 32 to secure the first or second extension 25, 30 to the first adversarial profile 15. The cylindrical bores 27, 32 are provided on an edge of the first adversarial profile 15 facing the second adversarial profile 20. The cylindrical bores 27, 32 have a bottom or floor that prevents the pegs 28, 33 from sliding completely through the bore 27, 32. The cylindrical bore 27 is located at a middle portion 16 of the first adversarial profile 15. The cylindrical bore 32 is located at the upper portion 50 of the first adversarial profile 15. A slot 26, 31 runs along the length of the cylindrical bores 27, 32. The slots 26, 31 accommodate the end portion of the first and second extensions 25, 30 that connect with the cylindrical pegs 28, 33. In this way, the user can easily and quickly change the first and second extensions 25, 30 by sliding the pegs 28, 33 through the bore 27, 32. That is, the first and second extensions 25, 30 can be replaced by sliding the peg 28, 33 out of the cylindrical bore 27, 32 and then sliding another desired extension 25, 30 into the corresponding bore 27, 32.

At the lower end 40 of the first adversarial profile 15 and at the lower end 42 of the second adversarial profile are attachment holes 43, preferably two, for affixing the body 12 to the mounting element 60. In another embodiment, the body 12 and the mounting element 60 can be made of one piece so that the mounting element 60 is integral with the device 10 and does not need to be attached to the body 12 via attachment holes 43.

Figure 3:
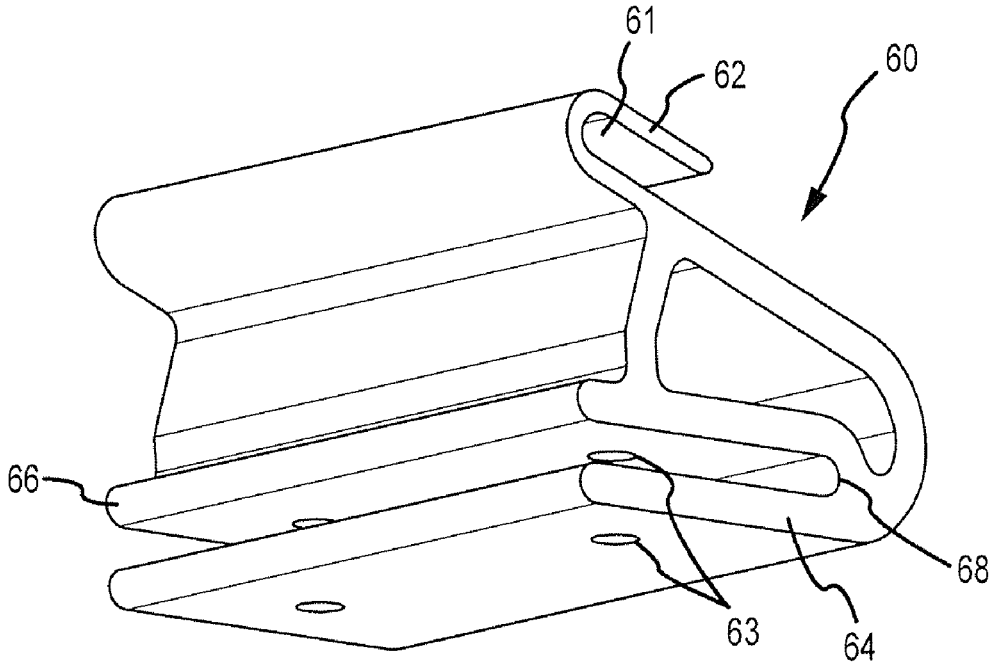
FIG. 3 is a perspective view of a mounting element for the vehicle mountable display device according to one embodiment of the present invention.

Referring to FIG. 3, one embodiment of the mounting element 60 is generally in a U shape. The mounting element 60 is made of composite material that is rigid in nature. The mounting element 60 has a first lip 62 that curls over to form a slot 61. On the side of the mounting element 60 opposite the first lip 62 is a second lip 64 and a third lip 66. The second and third lips 64, 66 form a slot 68 there between. The second and third lips 64, 66 both have attachment holes 63. The lower portion 40 or 42 slides into the slot 68 and is secured using the attachment holes 43, 63.

Figure 4:
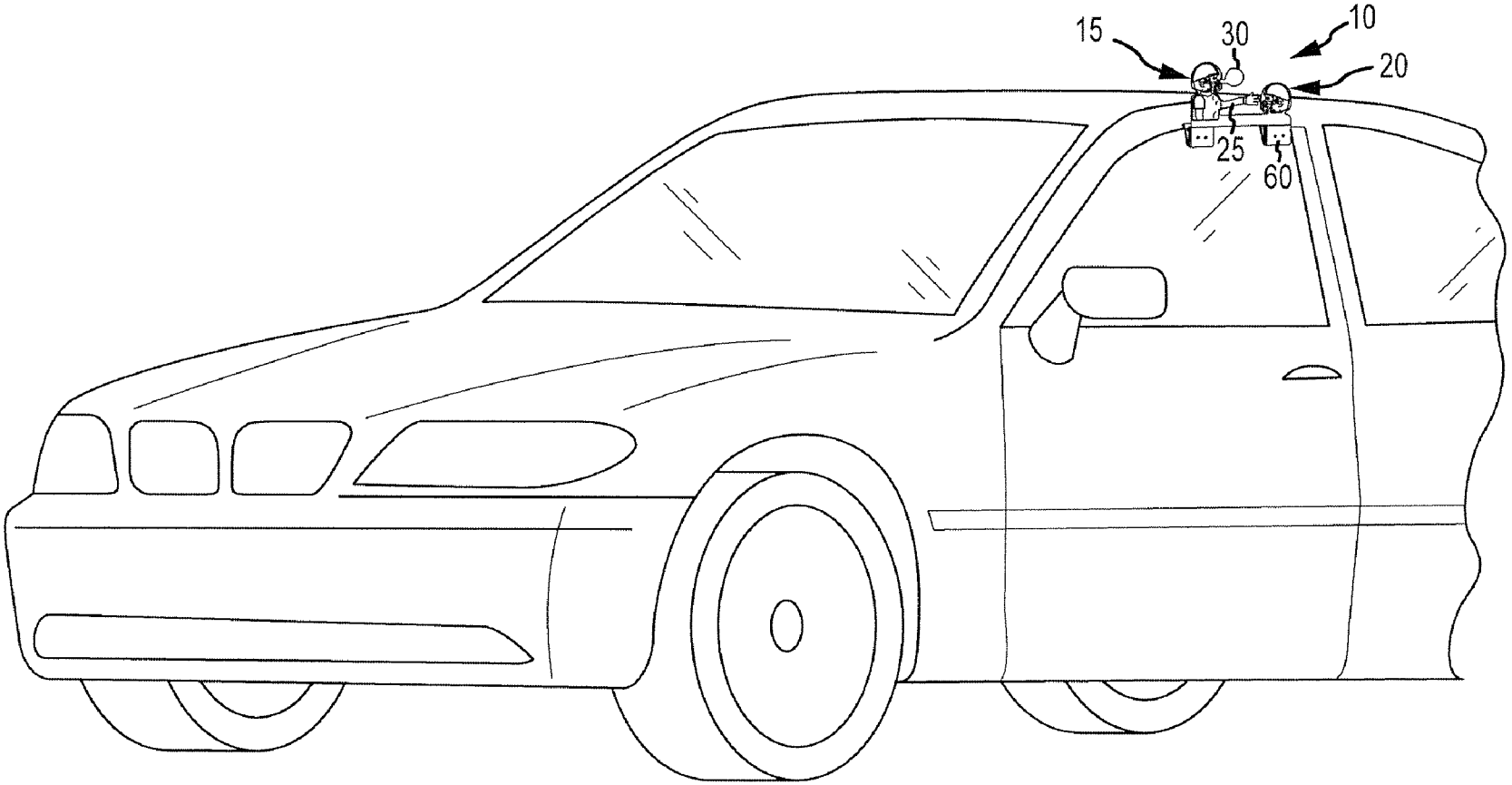
FIG. 4 shows the vehicle mountable display device mounted to a vehicle window using an embodiment of the mounting element.

The mounting element 60 can be configured to mount to a vehicle in a variety of ways. One example is illustrated in FIG. 4, wherein the first lip 62 is designed to "hook" the vehicle mountable display device 10 onto the top of the vehicle window. The vehicle mountable display device 10 is secured by inserting the vehicle window into slot 61 and trapping the first lip 62 between the vehicle window and the vehicle door once the window is fully rolled up. Another example of mounting to a vehicle is illustrated in FIG. 5. In this example, one or more suction cups 80 are attached to the first lip 62. The suction cups 80 are then attached to the vehicle window.

In understanding the scope of the present invention, the term "comprising" and its derivatives, as used herein, are intended to be open ended terms that specify the presence of the stated features, elements, and/or components, but do not exclude the presence of other unstated features, elements, and/or components. The foregoing also applies to words having similar meanings such as the terms, "including", "having" and their derivatives. The terms of degree such as "substantially", "about" and "approximate" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Thus, the foregoing descriptions of the embodiments according to the present invention are provided for illustration only, and not for the purpose of limiting the invention as defined by the appended claims and their equivalents.

What is claimed is:

1. The vehicle mountable display device comprising:

a mounting element configured to mount to a vehicle; and a body coupled to the mounting element and including a first adversarial profile disposed on the body, a second adversarial profile opposed to the first adversarial profile and disposed on the body, and an extension attached to the first adversarial profile and extending towards the second adversarial profile, wherein the first adversarial profile is sized or positioned to show superiority over the second adversarial profile, and the extension is configured to oscillate to provide an appearance of slapping or hitting the second adversarial profile;

wherein the extension is made of a flexible material to allow the extension to oscillate; and a second extension attached to the first adversarial profile, wherein the second extension extends from the first adversarial profile towards the second adversarial profile.

2. The vehicle mountable display device of claim 1, wherein the second extension is slidably removable from the first adversarial profile.

3. The vehicle mountable display device of claim 1, wherein the second extension includes a sign.

4. The vehicle mountable display device of claim 1, wherein the second extension includes a tongue.

5. A vehicle mountable display device comprising:

a body including a first adversarial profile defining a plane, and a second adversarial profile opposed to the first adversarial profile, the plane substantially extending towards the second adversarial profile;

an extension attached to the first adversarial profile and extending towards the second adversarial profile, the extension being pivotably or flexibly configured to oscillate from one side of the plane to the other side of the plane in an appearance of slapping or hitting the second adversarial profile; and a mounting element coupled to the body and configured to mount to a vehicle.

6. The vehicle mountable display device of claim 5, wherein the extension and the first adversarial profile are a unitary, integral one-piece member.

7. The vehicle mountable display device of claim 5, wherein the extension is in the shape of a human appendage and attachable to the first adversarial profile.

8. The vehicle mountable display device of claim 6, wherein the extension includes a portion in the shape of a baseball bat, a hockey stick, or a boxing glove.

9. The vehicle mountable display device of claim 5, further comprising a second extension attached to the first adversarial profile, wherein the second extension extends from the first adversarial profile towards the second adversarial profile.

10. The vehicle mountable display device of claim 9, wherein the second extension includes a sign.

11. The vehicle mountable display device of claim 9, wherein the second extension includes a tongue.

12. The vehicle mountable display device of claim 5, wherein the first and second adversarial profiles each include an image of an athlete, team mascot or team logo.

* * * * *